US010838354B2

(12) United States Patent
Fujii et al.

(10) Patent No.: US 10,838,354 B2
(45) **Date of Patent: *Nov. 17, 2020**

(54) IMAGE FORMING APPARATUS INCLUDING DRUM CARTRIDGE INCLUDING SWING PLATE CONFIGURED TO SUPPORT DEVELOPING CARTRIDGE

(71) Applicant: Brother Kogyo Kabushiki Kaisha, Nagoya (JP)

(72) Inventors: Yasumasa Fujii, Anjo (JP); Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/580,614

(22) Filed: Sep. 24, 2019

(65) Prior Publication Data

US 2020/0019116 A1 Jan. 16, 2020

Related U.S. Application Data

(63) Continuation of application No. 16/055,849, filed on Aug. 6, 2018, now Pat. No. 10,444,698.

(30) Foreign Application Priority Data

Sep. 11, 2017 (JP) ..... 2017-173674

(51) Int. Cl.
*G03G 21/18* (2006.01)
*G03G 21/16* (2006.01)

(52) U.S. Cl.
CPC ..... *G03G 21/1842* (2013.01); *G03G 21/1676* (2013.01); *G03G 21/1814* (2013.01); *G03G 21/1864* (2013.01)

(58) Field of Classification Search
CPC ..... G03G 21/1842; G03G 21/1676; G03G 21/1814; G03G 21/1821; G03G 21/1825; G03G 2221/1853
See application file for complete search history.

(56) References Cited

U.S. PATENT DOCUMENTS 6,101,350 A 8/2000 Suzuki et al.
9,256,196 B2 2/2016 Sato et al.
(Continued)

FOREIGN PATENT DOCUMENTS

JP H07-234552 A 9/1995
JP 2015-175934 A 10/2015

*Primary Examiner* — Sandra Brase
(74) *Attorney, Agent, or Firm* — Banner & Witcoff, Ltd.

(57) ABSTRACT

An image forming apparatus includes an apparatus main body, a drum cartridge, and a developing cartridge. The apparatus main body is formed with an opening. The drum cartridge includes a photosensitive drum and is configured to be installed into the apparatus main body through the opening. The developing cartridge includes a developing roller and is configured to be installed into the drum cartridge. The drum cartridge includes a swing plate configured to support the developing cartridge installed in the drum cartridge. The swing plate is configured to swingably move such that the developing roller moves relative to the photosensitive drum. The swing plate includes a first guide configured to guide installation of the developing cartridge into the drum cartridge.

19 Claims, 13 Drawing Sheets

(56) References Cited

U.S. PATENT DOCUMENTS

| | | | | |
|---|---|---|---|---|
| 9,513,596 | B2 | 12/2016 | Sato et al. | |
| 10,444,698 | B2 * | 10/2019 | Fujii | G03G 21/1676 |
| 2009/0175652 | A1 | 7/2009 | Kamimura | |
| 2014/0205321 | A1 | 7/2014 | Jang et al. | |
| 2015/0261179 | A1 | 9/2015 | Sato et al. | |
| 2016/0154372 | A1 | 6/2016 | Sato et al. | |
| 2017/0075292 | A1 | 3/2017 | Nagae et al. | |
| 2018/0024494 | A1 | 1/2018 | Shibuya et al. | |
| 2018/0239301 | A1 * | 8/2018 | Kudo | G03G 21/1857 |

* cited by examiner

IMAGE FORMING APPARATUS INCLUDING DRUM CARTRIDGE INCLUDING SWING PLATE CONFIGURED TO SUPPORT DEVELOPING CARTRIDGE

CROSS REFERENCE TO RELATED APPLICATIONS

This application is a continuation of U.S. patent application Ser. No. 16/055,849 filed Aug. 6, 2018 which claims priority from Japanese Patent Application No. 2017-173674 filed Sep. 11, 2017. The entire content of the priority application is incorporated herein by reference.

TECHNICAL FIELD

This disclosure relates to an image forming apparatus.

BACKGROUND

An image forming apparatus is conventionally known. The image forming apparatus includes an apparatus main body, a drum cartridge configured to be installed in the apparatus main body, and a developing cartridge configured to be installed in the apparatus main body.

The drum cartridge includes a photosensitive drum. The developing cartridge includes a developing roller. In a state where the drum cartridge and the developing cartridge are installed in the apparatus main body, the developing roller contacts the photosensitive drum.

SUMMARY

According to one aspect, this specification discloses an image forming apparatus. The image forming apparatus includes an apparatus main body, a drum cartridge, and a developing cartridge. The apparatus main body is formed with an opening. The drum cartridge includes a photosensitive drum and is configured to be installed into the apparatus main body through the opening. The developing cartridge includes a developing roller and is configured to be installed into the drum cartridge.

The drum cartridge includes a swing plate configured to support the developing cartridge installed in the drum cartridge. The swing plate is configured to swingably move such that the developing roller moves relative to the photosensitive drum. The swing plate includes a first guide configured to guide installation of the developing cartridge into the drum cartridge.

BRIEF DESCRIPTION OF THE DRAWINGS

Embodiments in accordance with this disclosure will be described in detail with reference to the following figures wherein.

DETAILED DESCRIPTION

In the above-described image forming apparatus, it is desired that the developing roller is configured to move relative to the photosensitive drum in a state where the drum cartridge and the developing cartridge are installed, and the developing roller is pressed toward the photosensitive drum, thereby suitably maintaining the positional relationship between the developing roller and the photosensitive drum.

An example of an object of this disclosure is to provide an image forming apparatus in which the developing roller is configured to move relative to the photosensitive drum in a state where the drum cartridge in which the developing cartridge is installed is installed in the apparatus main body.

1. Overview of Image Forming Apparatus 1

Figure 1A:
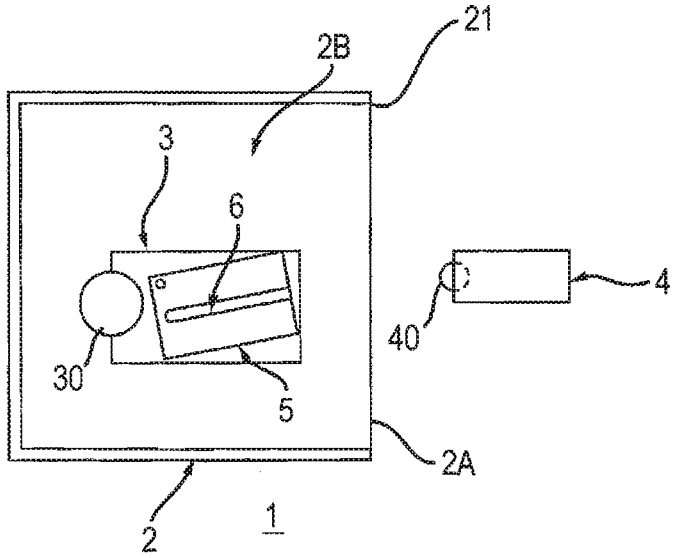
FIG. 1A is a schematic diagram showing an image forming apparatus of this disclosure, and shows a state before a developing cartridge is installed into a drum cartridge.
Figure 1B:
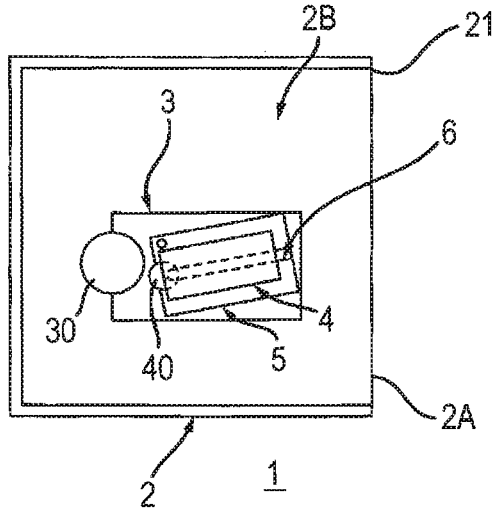
FIG. 1B shows a state where the developing cartridge is installed in the drum cartridge, continuing from FIG. 1A.
Figure 1C:
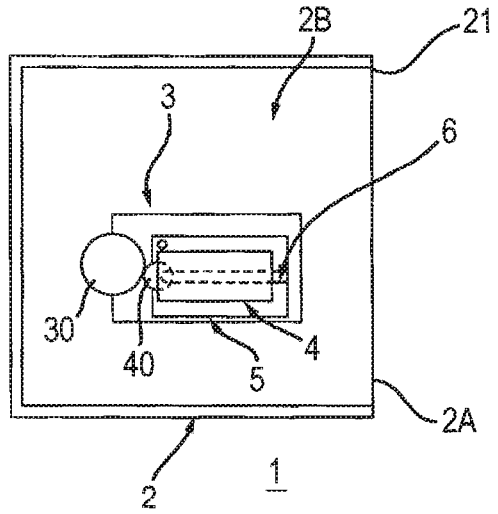
FIG. 1C shows a state where a swing plate is swingably moved, continuing from FIG. 1B.

The overview of an image forming apparatus 1 will be described while referring to FIG. 1A to FIG. 1C.

The image forming apparatus 1 includes an apparatus main body 2, a drum cartridge 3, and a developing cartridge 4.

1.1 Apparatus Main Body 2

The apparatus main body 2 is formed with an opening 21 and an internal space 2B in communication with the opening 21. The opening 21 is provided at a side 2A of the apparatus main body 2. The opening 21 is commonly used both when the drum cartridge 3 is installed into the apparatus main body 2 and when the developing cartridge 4 is installed into the drum cartridge 3 installed in the apparatus main body 2.

The internal space 2B is configured to accommodate the drum cartridge 3 in which the developing cartridge 4 is installed.

1.2 Drum Cartridge 3

The drum cartridge 3 is configured to be installed into the apparatus main body 2 through the opening 21. When the drum cartridge 3 is installed into the apparatus main body 2, the drum cartridge 3 is accommodated into the internal space 2B through the opening 21. The drum cartridge 3 includes a photosensitive drum 30 and a swing plate 5.

1.3 Developing Cartridge 4

The developing cartridge 4 is configured to be installed in the drum cartridge 3. When the developing cartridge 4 is installed into the drum cartridge 3 installed in the apparatus main body 2, the developing cartridge 4 is accommodated into the internal space 2B through the opening 21. The developing cartridge 4 includes a developing roller 40.

1.4 Swing Plate 5

The swing plate 5 supports the developing cartridge 4 installed in the drum cartridge 3. The swing plate 5 has a first guide 6. The first guide 6 guides installation of the developing cartridge 4 into the drum cartridge 3. The first guide 6 extends in the installation direction of the developing cartridge 4. The installation direction of the developing cartridge 4 is the direction in which the developing cartridge 4 is guided by the first guide 6 when the developing cartridge 4 is installed into the drum cartridge 3. In a state where the developing cartridge 4 is installed in the drum cartridge 3, the swing plate 5 is configured to swingably move such that the developing roller 40 moves relative to the photosensitive drum 30.

2. First Embodiment

An image forming apparatus 10 according to a first embodiment will be described while referring to FIG. 2 to FIG. 7. In the image forming apparatus 10 of the first embodiment, parts and components similar to those described in the overview of the above-described image forming apparatus 1 are designated by the same reference numerals to avoid duplicating description.

Figure 2:
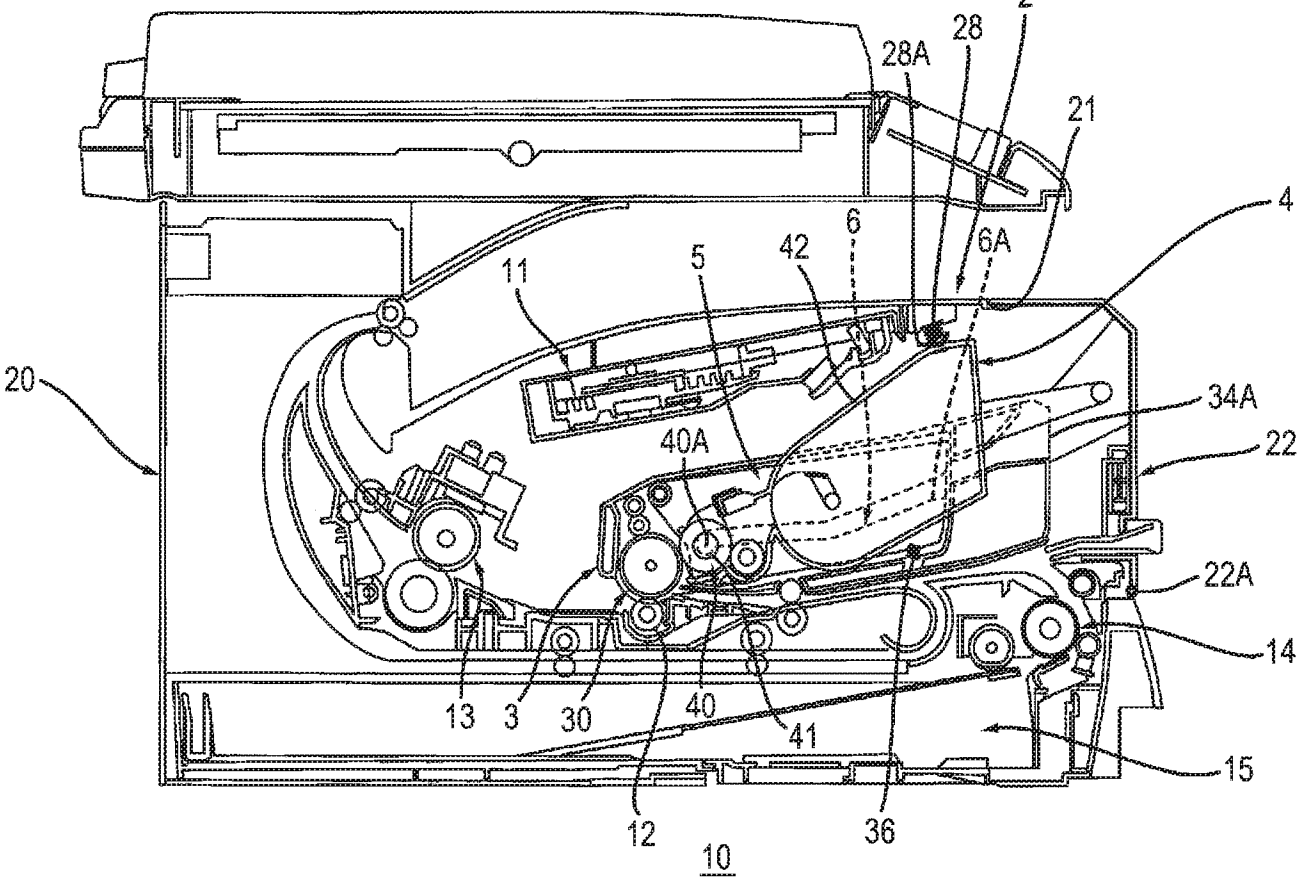
FIG. 2 is a cross-sectional view of an image forming apparatus of a first embodiment, and shows a state where the swing plate is located at an adjacent position.

As shown in FIG. 2, the image forming apparatus 10 includes the apparatus main body 2, the drum cartridge 3, and the developing cartridge 4.

The apparatus main body 2 includes a main casing 20, a laser scan unit 11, a transfer roller 12, a fixing device 13, a paper feed tray 15, and a paper feeder 14.

The main casing 20 includes the opening 21 and the cover 22. That is, the apparatus main body 2 includes the cover 22. The cover 22 is a front cover provided at a side wall of the apparatus main body 2. The cover 22 is configured to move between an open position at which the opening 21 is opened (see FIG. 4) and a closed position at which the opening 21 is closed. The cover 22 has a rotational axis 22A. The cover 22 is configured to rotatably move between the open position and the closed position about the rotational axis 22A. The rotational axis 22A is rotatably supported by the main casing 20. The rotational axis 22A is located at a lower position than the opening 21. The main casing 20 accommodates the laser scan unit 11, the transfer roller 12, the fixing device 13, the paper feed tray 15, and the paper feeder 14. Inside the main casing 20, the internal space 2B is located between the fixing device 13 and the cover 22 located at the closed position, and is located between the laser scan unit 11 and the transfer roller 12.

The laser scan unit 11 is configured to expose the photosensitive drum 30 to light. The transfer roller 12 is configured to transfer a toner image formed on a surface of the photosensitive drum 30 onto paper. The transfer roller 12 contacts the surface of the photosensitive drum 30 in a state where the drum cartridge 3 is installed in the apparatus main body 2. The fixing device 13 is configured to heat and apply pressure to paper on which a toner image is transferred, thereby fixing the toner image on the paper. The paper feed tray 15 is configured to accommodate paper. The paper feeder 14 is configured to supply paper in the paper feed tray 15 to between the photosensitive drum 30 and the transfer roller 12.

2.1 Detail of Developing Cartridge 4

The developing cartridge 4 includes a frame 42 and the developing roller 40.

The frame 42 accommodates toner. The frame 42 supports the developing roller 40.

The developing roller 40 is configured to supply toner to the photosensitive drum 30. In a state where the developing cartridge 4 is installed in the drum cartridge 3, the developing roller 40 contacts the surface of the photosensitive drum 30. The developing roller 40 is configured to rotate about a rotational axis 40A extending in the axial direction. The axial direction intersects both the upper-lower direction and the installation direction of the developing cartridge 4. Preferably, the axial direction is perpendicular to both the upper-lower direction and the installation direction of the developing cartridge 4. The developing roller 40 includes a developing shaft 41 extending along the rotational axis 40A of the developing roller 40.

Figure 3:
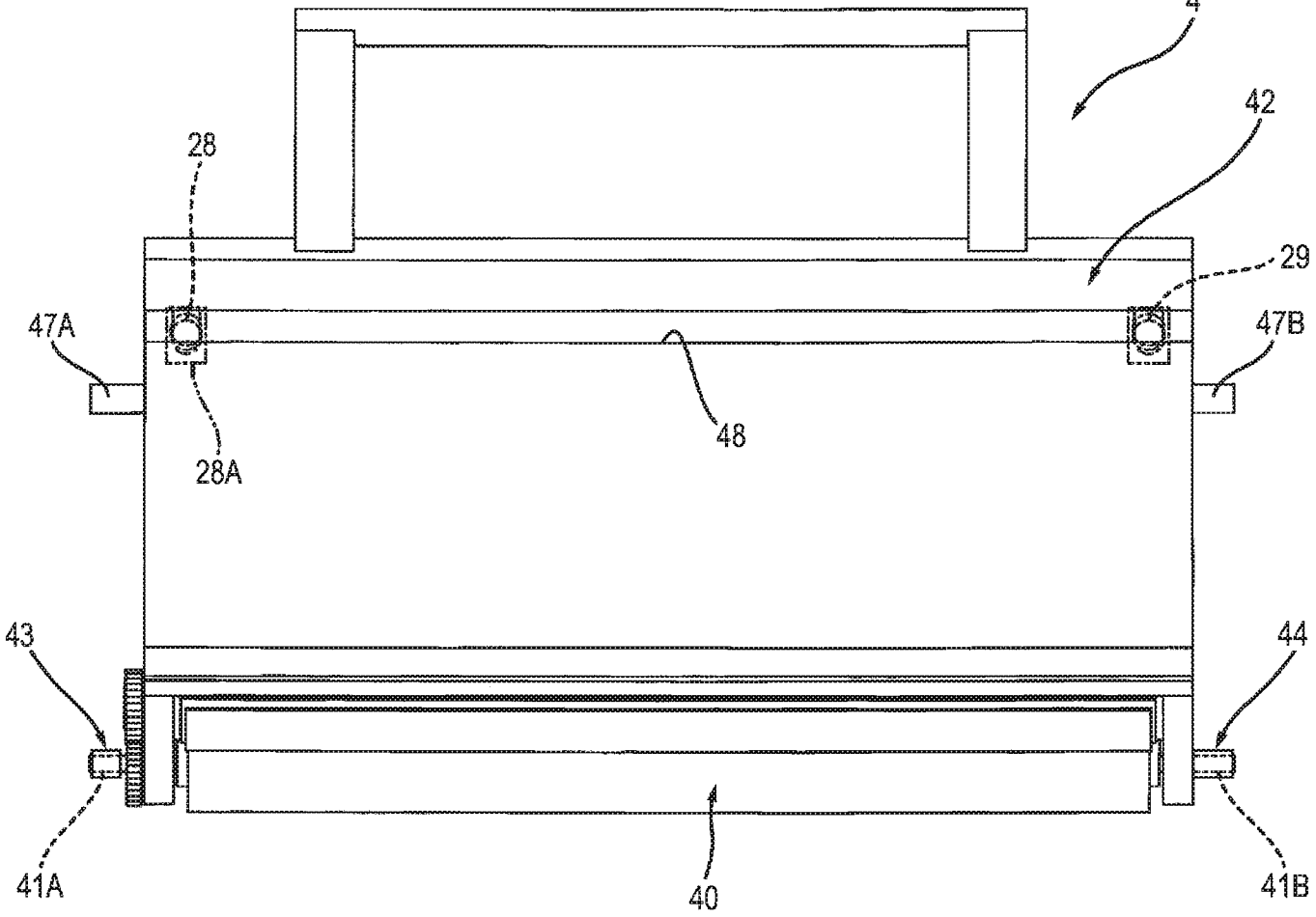
FIG. 3 is a plan view of the developing cartridge shown in FIG. 2.

As shown in FIG. 3, the developing cartridge 4 includes a protrusion 43, a first boss 47A, a second protrusion 44, and a second boss 47B. The protrusion 43 and the first boss 47A are located at one end side with respect to the frame 42 in the axial direction. The second protrusion 44 and the second boss 47B are located at the other end side with respect to the frame 42 in the axial direction.

The protrusion 43 protrudes from the frame 42. The protrusion 43 has a columnar shape. The protrusion 43 includes a part of the developing shaft 41. The developing shaft 41 has one end portion 41A and an other end portion 41B in the axial direction. Specifically, the protrusion 43 includes the one end portion 41A of the developing shaft 41. The first boss 47A protrudes from the frame 42. The first boss 47A has a columnar shape. The first boss 47A is located at the upstream side of the protrusion 43 in the installation direction of the developing cartridge 4.

The second protrusion 44 has the same shape as the protrusion 43. The second protrusion 44 includes a part of the developing shaft 41. Specifically, the second protrusion 44 includes the other end portion 41B of the developing shaft 41. The second boss 47B has the same shape as the first boss 47A. The second boss 47B is located at the upstream side of the second protrusion 44 in the installation direction of the developing cartridge 4.

2.2 Detail of Drum Cartridge 3

Figure 4:
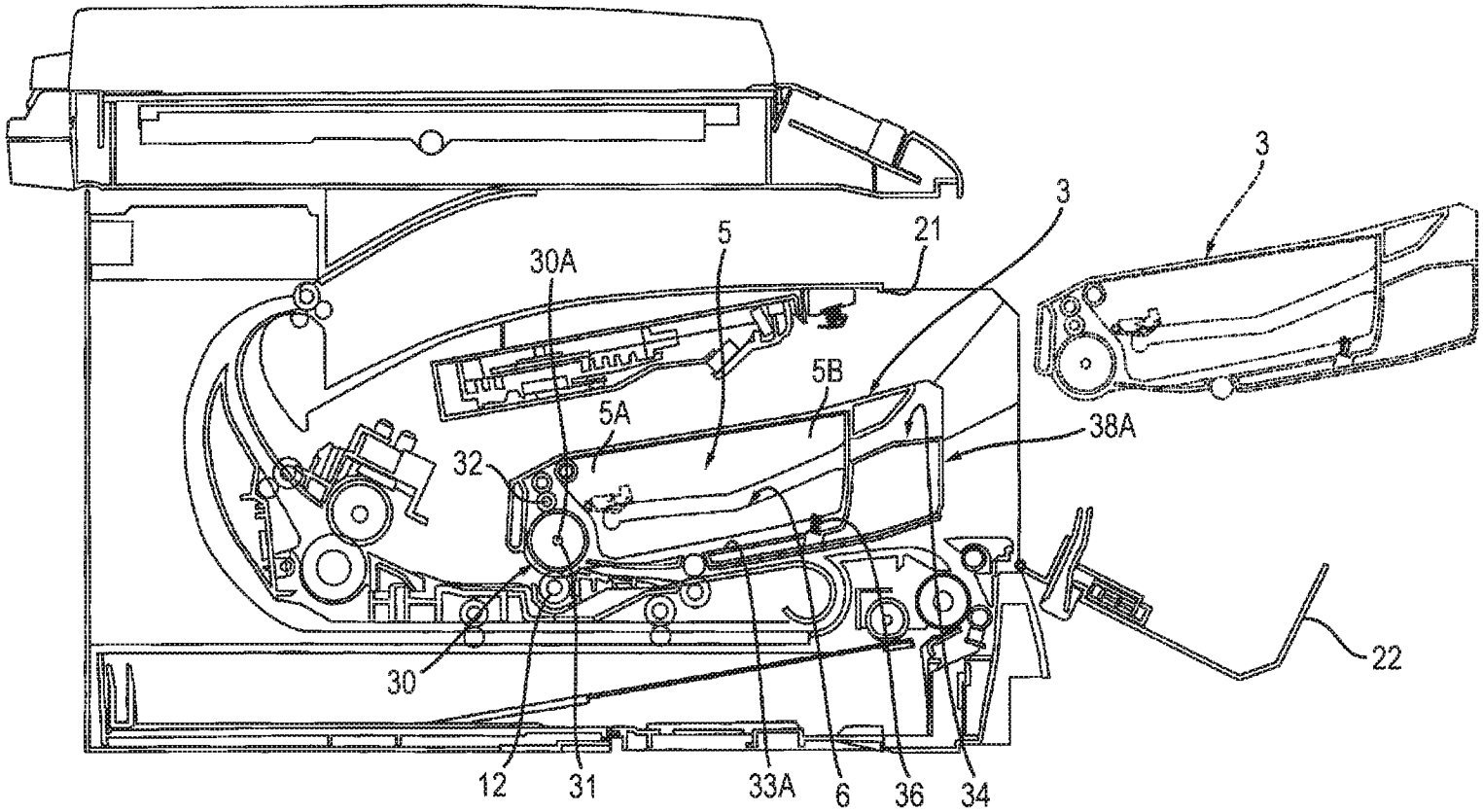
FIG. 4 is a cross-sectional view of an apparatus main body and a drum cartridge shown in FIG. 2, and shows a state where the swing plate is located at a spaced position.

As shown in FIG. 4, the drum cartridge 3 includes the photosensitive drum 30 and a charging roller 32. The photosensitive drum 30 is configured such that a toner image is formed on the surface thereof. The photosensitive drum 30 is configured to rotate about a rotational axis 30A extending in the axial direction. The photosensitive drum 30 includes a drum shaft 31 extending along the rotational axis 30A of the photosensitive drum 30. The charging roller 32 is configured to charge the surface of the photosensitive drum 30. The charging roller 32 contacts the surface of the photosensitive drum 30.

Figure 5:
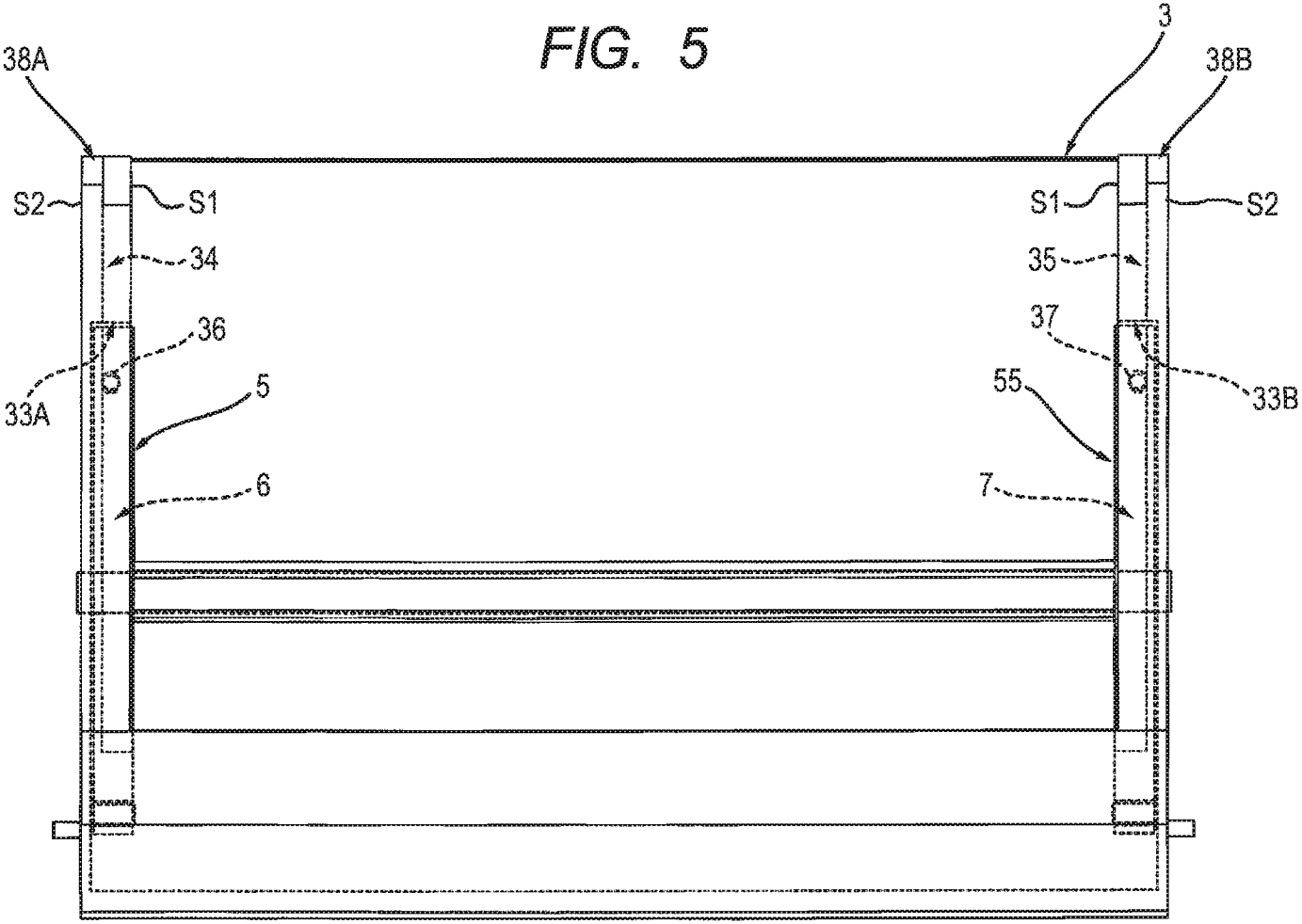
FIG. 5 is a plan view of the drum cartridge shown in FIG. 4.

As shown in FIG. 5, the drum cartridge 3 includes a first side frame 38A, a second side frame 38B, a first concave portion 33A, a second concave portion 33B, the swing plate 5 having the first guide 6, a second guide 34, a second swing plate 55 having a third guide 7, a fourth guide 35, a second pressing spring 36, and a fourth pressing spring 37.

2.2.1 First Side Frame 38A and Second Side Frame 38B

The first side frame 38A and the second side frame 38B rotatably support the photosensitive drum 30 and the charging roller 32 (see FIG. 4). The first side frame 38A extends in a direction intersecting the axial direction. The first side frame 38A has an inner surface S1 and an outer surface S2 in the axial direction. In a state where the developing cartridge 4 is installed in the drum cartridge 3 (see FIG. 2), the outer surface S2 is located at the opposite side from the developing cartridge 4 with respect to the inner surface S1 in the axial direction. In a state where the developing cartridge 4 is installed in the drum cartridge 3 (see FIG. 2), the second side frame 38B is located at the opposite side from the first side frame 38A with respect to the drum cartridge 3 in the axial direction. Like the first side frame 38A, the second side frame 38B extends in a direction intersecting the axial direction, and has an inner surface S1 and an outer surface S2 in the axial direction. The first concave portion 33A, the second guide 34, the swing plate 5, and the second pressing spring 36 are provided at the first side frame 38A. The second concave portion 33B, the fourth guide 35, the second swing plate 55, and the fourth pressing spring 37 are provided at the second side frame 38B.

2.2.2 First Concave Portion 33A and Second Guide 34

Figure 6A:
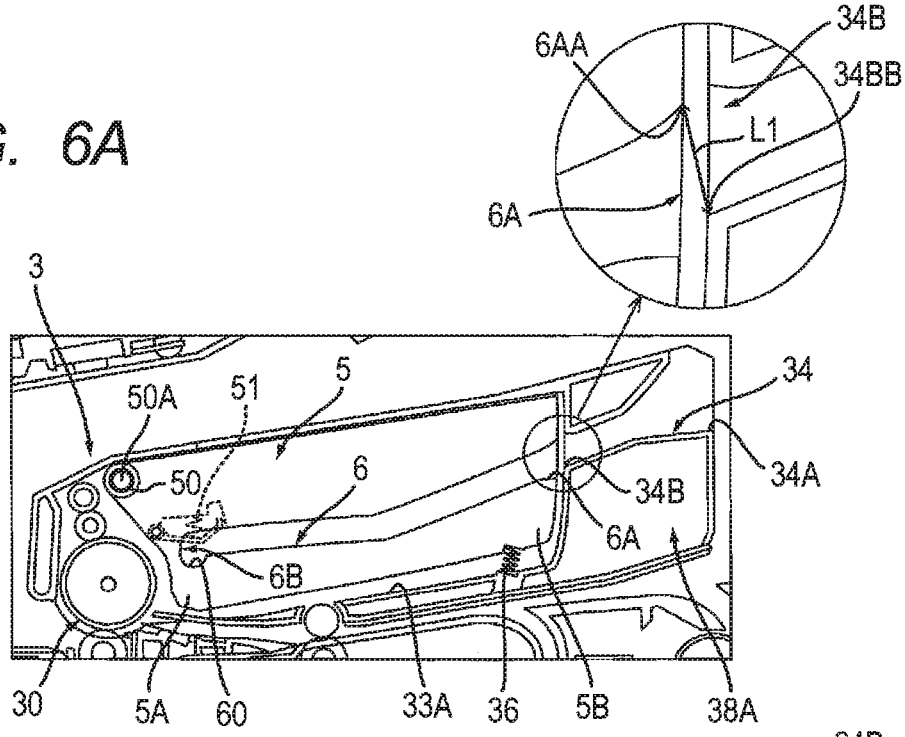
FIG. 6A is an enlarged view of the swing plate located at the spaced position shown in FIG. 4.
Figure 6B:
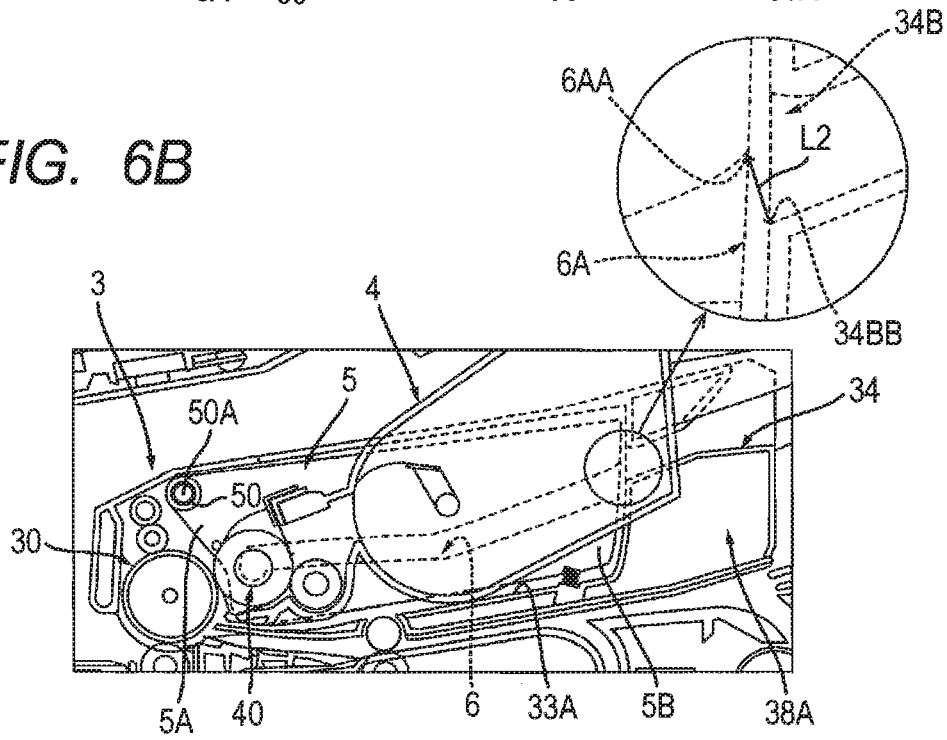
FIG. 6B is an enlarged view of the swing plate located at the adjacent position shown in FIG. 2.

As shown in FIG. 6A and FIG. 6B, the first concave portion 33A accommodates the swing plate 5 having the first guide 6. The second guide 34 guides installation of the developing cartridge 4 into the drum cartridge 3. The second guide 34 guides the developing cartridge 4 to the first guide 6 of the swing plate 5. The second guide 34 is located at the upstream side of the first guide 6 in the installation direction of the developing cartridge 4. The second guide 34 is a groove. The second guide 34 may be a rib. The second guide 34 extends in the installation direction of the developing cartridge 4. The second guide 34 has an upstream end 34A and a downstream end 34B in the installation direction of the developing cartridge 4. The upstream end 34A of the second guide 34 is opened toward the opening 21 (see FIG. 2). In a state where the cover 22 is located at the closed position, the upstream end 34A of the second guide 34 is opened toward the cover 22 (see FIG. 2). The downstream end 34B of the second guide 34 is in communication with the first concave portion 33A.

2.2.3 Detail of Swing Plate 5

As shown in FIG. 6A, the swing plate 5 is arranged inside the first concave portion 33A. The swing plate 5 has the first guide 6 and a first pressing spring 51.

2.2.3.1 First Guide 6

Figure 7:
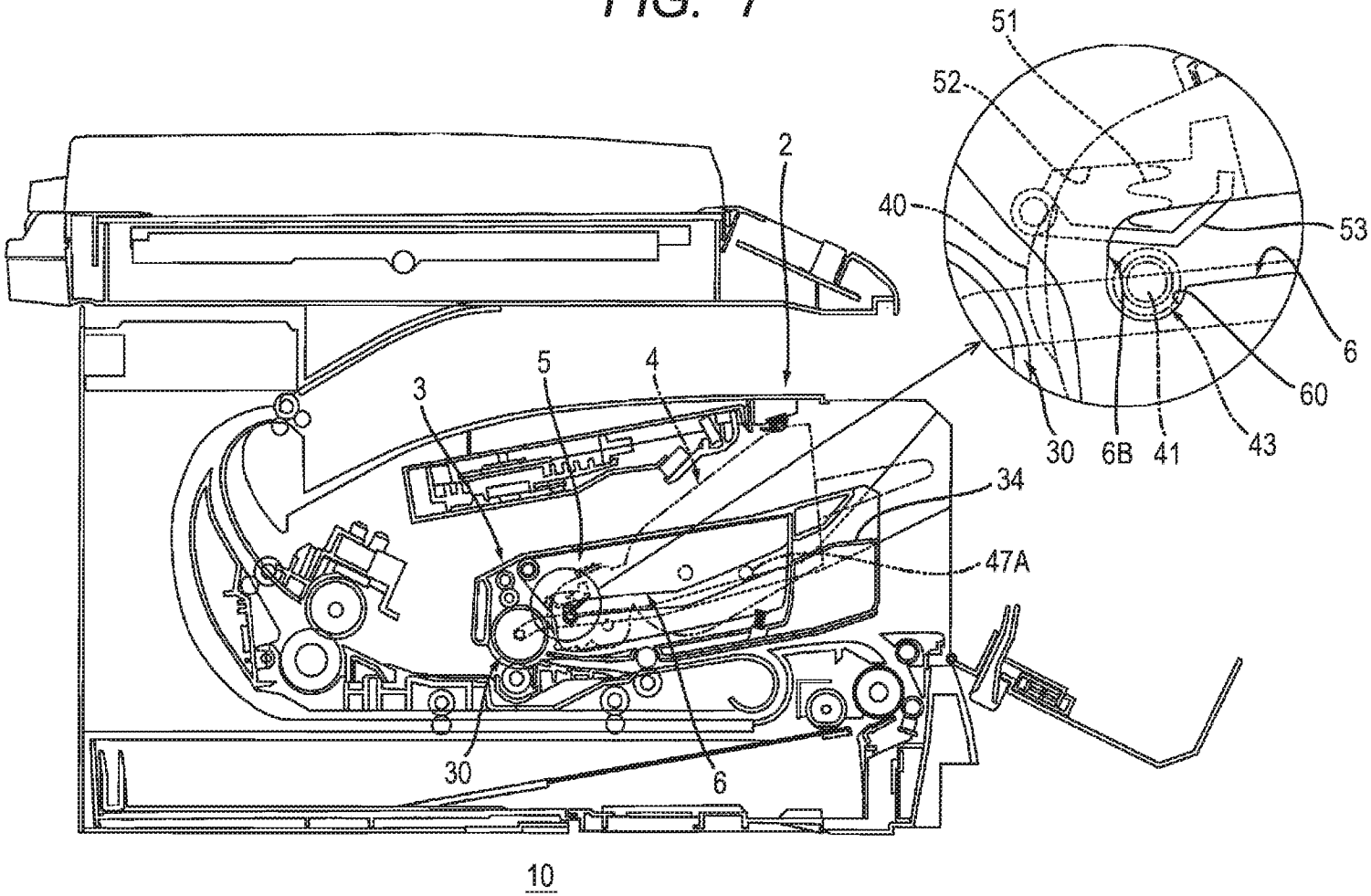
FIG. 7 is a cross-sectional view of the image forming apparatus shown in FIG. 2, and shows a state where the swing plate is located at the spaced position, where the developing cartridge is shown by the imaginary lines.

When the developing cartridge 4 is installed into the drum cartridge 3, the first guide 6 guides the protrusion 43 (see FIG. 7). Specifically, when the developing cartridge 4 is installed into the drum cartridge 3, the first guide 6 guides a first boss 47A and the protrusion 43 including one end portion 41A of the developing shaft 41 (see FIG. 7). The first guide 6 is a groove. The first guide 6 may be a rib. The first guide 6 extends in the installation direction of the developing cartridge 4. The first guide 6 has an upstream end 6A and a downstream end 6B in the installation direction of the developing cartridge 4. The upstream end 6A of the first guide 6 is located at the downstream side of the downstream end 34B of the second guide 34 in the installation direction of the developing cartridge 4. The upstream end 6A of the first guide 6 is wider as the upstream end 6A approaches the downstream end 34B of the second guide 34. In a state where the cover 22 is located at the closed position, the upstream end 6A of the first guide 6 is opened toward the cover 22 (see FIG. 2). The downstream end 6B of the first guide 6 is closed. As shown in FIG. 7, the downstream end 6B of the first guide 6 has a concave portion 60 that is concave along the protrusion 43. In a state where the developing cartridge 4 is installed in the drum cartridge 3, the protrusion 43 is located at the downstream end 6B of the first guide 6 and is fitted in the concave portion 60.

2.2.3.2 First Pressing Spring 51

In a state where the developing cartridge 4 is installed in the drum cartridge 3, the first pressing spring 51 presses the protrusion 43 downward from above, and causes the protrusion 43 to contact the first guide 6. Specifically, in a state where the developing cartridge 4 is installed in the drum cartridge 3, the first pressing spring 51 presses the protrusion 43 downward from above, and causes the protrusion 43 to contact the concave portion 60 of the first guide 6. The first pressing spring 51 is located at the upper side of the protrusion 43 located at the downstream end 6B of the first guide 6. The first pressing spring 51 is arranged in a groove 52 formed in the swing plate 5. The first pressing spring 51 extends in the upper-lower direction. The upper end of the first pressing spring 51 contacts the inner surface of the groove 52. The lower end of the first pressing spring 51 contacts a swing portion 53 swingably provided at the swing plate 5. The swing portion 53 contacts the protrusion 43 located at the downstream end 6B of the first guide 6. In a state where the swing portion 53 contacts the protrusion 43, the first pressing spring 51 is compressed in the upper-lower direction. In a compressed state, the first pressing spring 51 presses the protrusion 43 with elastic force.

2.2.3.3 Spaced Position and Adjacent Position of Swing Plate 5

As shown in FIG. 6A and FIG. 6B, the swing plate 5 is configured to, in a state where the developing cartridge 4 is installed in the drum cartridge 3, swing between: an adjacent position (see FIG. 6B) at which the developing roller 40 contacts or is adjacent to the photosensitive drum 30; and a spaced position (see FIG. 6A and FIG. 7) at which the developing roller 40 is spaced farther from the photosensitive drum 30 than at the adjacent position. When the swing plate 5 is located at the spaced position in a state where the developing cartridge 4 is installed in the drum cartridge 3, the swing plate 5 allows the developing cartridge 4 to be guided from the first guide 6 to the second guide 34 (see FIG. 6A and FIG. 7).

The spaced position is a position at which, in a state where the developing cartridge 4 is installed in the drum cartridge 3, the developing roller 40 is spaced from the photosensitive drum 30, and the developing roller 40 does not contact the photosensitive drum 30. Further, the spaced position is a position at which movement of toner from the developing roller 40 to the photosensitive drum 30 is not possible.

The adjacent position is a position at which the developing roller 40 contacts the photosensitive drum 30 in a state where the developing cartridge 4 is installed in the drum cartridge 3, or a position at which the developing roller 40 is located closer to the photosensitive drum 30 than at the spaced position but the developing roller 40 does not contact the photosensitive drum 30 in a state where the developing cartridge 4 is installed in the drum cartridge 3. Further, the adjacent position is a position at which movement of toner from the developing roller 40 to the photosensitive drum 30 is possible.

The swing plate 5 is configured to swingably move between the spaced position and the adjacent position about a swing center (swing axis) 50A extending in the axial direction, that is, in a direction intersecting the installation direction of the developing cartridge 4. In a state where the developing cartridge 4 is installed in the drum cartridge 3, the swing center 50A of the swing plate 5 is located at a higher position than the developing roller 40 is (see FIG. 6B). The swing plate 5 extends in a direction intersecting the axial direction. The swing plate 5 has one end portion 5A closer to the photosensitive drum 30 and an other end portion 5B farther from the photosensitive drum 30 in the installation direction of the developing cartridge 4. In a state where the drum cartridge 3 is installed in the apparatus main body 2, the other end portion 5B is closer to the opening 21 than the one end portion 5A is (see FIG. 4). The swing center 50A is located at the one end portion 5A of the swing plate 5. The swing plate 5 includes a swing shaft 50 extending along the swing center 50A of the swing plate 5. The swing shaft 50 rotatably supported by the first side frame 38A.

As shown in FIG. 6A, in a state where the swing plate 5 is located at the spaced position, the upstream end 6A of the first guide 6 is located relative to the downstream end 34B of the second guide 34 at such a position that the developing shaft 41 can move without being caught by the first guide 6 or the second guide 34 when the developing shaft 41 moves from the second guide 34 to the first guide 6. In a state where the swing plate 5 is located at the spaced position, the upstream end 6A of the first guide 6 is aligned with the downstream end 34B of the second guide 34. Specifically, in a state where the swing plate 5 is located at the spaced position, an upper end 6AA of the upstream end 6A of the first guide 6 is spaced from a lower end 34BB of the downstream end 34B of the second guide 34 with an interval L1 therebetween. In the direction perpendicular to the axial direction and passing through the upper end 6AA and the lower end 34BB, the length of the interval L1 is larger than the outer diameter of the developing shaft 41 and is larger than the outer diameter of the protrusion 43. With this configuration, in a state where the swing plate 5 is located at the spaced position, the upstream end 6A of the first guide 6 allows passage of the protrusion 43 including the one end portion 41A of the developing shaft 41.

As shown in FIG. 6B, in a state where the swing plate 5 is located at the adjacent position, the upstream end 6A of the first guide 6 is farther shifted (deviated) relative to the downstream end 34B of the second guide 34 than at the spaced position. In a state where the swing plate 5 is located at the adjacent position, the upstream end 6A of the first guide 6 is located relative to the downstream end 34B of the second guide 34 at a position where the developing shaft 41 gets caught by the first guide 6 or the second guide 34 when the developing shaft 41 moves from the first guide 6 to the second guide 34. That is, when the swing plate 5 moves from the spaced position to the adjacent position, the upstream end 6A of the first guide 6 is shifted relative to the downstream end 34B of the second guide 34 to an extent that the developing shaft 41 gets caught by the first guide 6 or the second guide 34 when the developing shaft 41 moves from the first guide 6 to the second guide 34. Specifically, in a state where the swing plate 5 is located at the adjacent position, an upper end 6AA of the upstream end 6A of the first guide 6 and a lower end 34BB of the downstream end 34B of the second guide 34 are spaced from each other with an interval L2 therebetween. In the direction perpendicular to the axial direction and passing through the upper end 6AA and the lower end 34BB, the length of the interval L2 is smaller than the outer diameter of the protrusion 43 and is smaller than the outer diameter of the developing shaft 41. In the present embodiment, the interval L2 is slightly smaller than the outer diameter of the protrusion 43. By strongly pushing the developing cartridge 4, the protrusion 43 can move from the second guide 34 to the first guide 6. With this configuration, in a state where the swing plate 5 is located at the adjacent position, the upstream end 6A of the first guide 6 hinders passage of the protrusion 43 including the one end portion 41A of the developing shaft 41. In a modification, the interval L2 may be sufficiently smaller than the outer diameter of the protrusion 43. In this case, the upstream end 6A of the first guide 6 prevents passage of the protrusion 43 including the one end portion 41A of the developing shaft 41.

As shown in FIG. 6A, in a state where the developing cartridge 4 is not installed in the drum cartridge 3, the swing plate 5 is located at the spaced position.

The drum cartridge 3 includes a second pressing spring 36. The second pressing spring 36 presses the swing plate 5 in the direction from the adjacent position toward the spaced position. The second pressing spring 36 is arranged at the lower side of the swing plate 5. Specifically, the second pressing spring 36 is arranged at the lower side of the other end portion 5B of the swing plate 5. The second pressing spring 36 is located between the other end portion 5B of the swing plate 5 and the inner surface of the first concave portion 33A. The second pressing spring 36 is located farther away from the swing center 50A than the first pressing spring 51 is. The second pressing spring 36 extends in the upper-lower direction. The second pressing spring 36 is compressed in the upper-lower direction in a state where the second pressing spring 36 is sandwiched between the other end portion 5B of the swing plate 5 and the inner surface of the first concave portion 33A. In a compressed state, the second pressing spring 36 presses the other end portion 5B of the swing plate 5 upward from below with elastic force. With this configuration, the second pressing spring 36 presses the swing plate 5 in the direction from the adjacent position toward the spaced position.

As shown in FIG. 6B, in a state where the drum cartridge 3 in which the developing cartridge 4 is installed is installed in the apparatus main body 2, the swing plate 5 is located at the adjacent position. With this configuration, the developing roller 40 contacts the photosensitive drum 30. As shown in FIG. 2, the apparatus main body 2 includes a third pressing spring 28. In a state where the drum cartridge 3 in which the developing cartridge 4 is installed is installed in the apparatus main body 2, the third pressing spring 28 presses the developing cartridge 4 and causes the swing plate 5 to be located at the adjacent position against the second pressing spring 36. The pressing force of the third pressing spring 28 is larger than the pressing force of the second pressing spring 36. In a state where the drum cartridge 3 is installed in the apparatus main body 2, the third pressing spring 28 is located at the opposite side from the second pressing spring 36 with respect to the first guide 6. In a state where the drum cartridge 3 in which the developing cartridge 4 is installed is installed in the apparatus main body 2, the third pressing spring 28 is located at the upper side of the frame 42. The third pressing spring 28 extends in the upper-lower direction. The upper end of the third pressing spring 28 is fixed to the apparatus main body 2. A contact portion 28A is fixed to the lower end of the third pressing spring 28. In a state where the developing cartridge 4 is installed in the apparatus main body 2, the contact portion 28A contacts the frame 42, specifically, a concave portion 48 formed in the frame 42 (see FIG. 3). In a state where the contact portion 28A contacts the frame 42, the third pressing spring 28 is compressed in the upper-lower direction. In a compressed state, the third pressing spring 28 presses the frame 42 downward from above with elastic force. In a state where the drum cartridge 3 in which the developing cartridge 4 is installed is installed in the apparatus main body 2, the third pressing spring 28 presses the frame 42 thereby causing the swing plate 5 to be located at the adjacent position against the second pressing spring 36.

2.2.4 Second Concave Portion 33B, Fourth Guide 35, Second Swing Plate 55, and Fourth Pressing Spring 37

As shown in FIG. 5, the second concave portion 33B accommodates the second swing plate 55 having the third guide 7. In cooperation with the second guide 34, the fourth guide 35 guides installation of the developing cartridge 4 into the drum cartridge 3. The fourth guide 35 guides the developing cartridge 4 to the third guide 7 of the second swing plate 55. The fourth guide 35 is located at the upstream side of the third guide 7 in the installation direction of the developing cartridge 4. The fourth guide 35 has the same shape as the second guide 34. The second swing plate 55 is spaced from the swing plate 5 in the axial direction. The second swing plate 55 has the same shape as the swing plate 5. The third guide 7 has the same shape as the first guide 6. The second swing plate 55 is arranged inside the second concave portion 33B. Like the swing plate 5, the second swing plate 55 is configured to swingably move between the spaced position and the adjacent position. The fourth pressing spring 37 has the same shape as the second pressing spring 36. The fourth pressing spring 37 presses the second swing plate 55 in the direction from the adjacent position toward the spaced position. As shown in FIG. 3, the apparatus main body 2 includes a third pressing spring 29 having the same shape as the third pressing spring 28. In a state where the drum cartridge 3 in which the developing cartridge 4 is installed is installed in the apparatus main body 2, the third pressing spring 29 presses the developing cartridge 4 thereby causing the second swing plate 55 to be located at the adjacent position against the fourth pressing spring 37.

2.3 Installation of Drum Cartridge 3 and Developing Cartridge 4

Next, installation of the drum cartridge 3 and developing cartridge 4 into the apparatus main body 2 will be described. In the following description, after the drum cartridge 3 is installed in the apparatus main body 2, the developing cartridge 4 is installed in the drum cartridge 3 inside the apparatus main body 2. Alternatively, after the developing cartridge 4 is installed in the drum cartridge 3, the drum cartridge 3 may be installed in the apparatus main body 2.

As shown in FIG. 4, first, the user puts the cover 22 at the open position, and installs the drum cartridge 3 into the apparatus main body 2. At this time, the swing plate 5 is located at the spaced position. Next, as shown in FIG. 7, when the user fits the developing cartridge 4 into the second guide 34 and pushes the developing cartridge 4 toward the photosensitive drum 30, the developing cartridge 4 is guided by the second guide 34 and thereafter guided by the first guide 6. At this time, after the protrusion 43 passes through the second guide 34, the protrusion 43 reaches the downstream end 6B of the first guide 6. And, the protrusion 43 is fitted in the concave portion 60. After the first boss 47A passes through the second guide 34, the first boss 47A is located inside the first guide 6. With this operation, the developing cartridge 4 is supported by the swing plate 5. As shown in FIG. 2, in a state where the developing cartridge 4 is supported by the swing plate 5, the third pressing spring 28 presses the developing cartridge 4. With this operation, the swing plate 5 swingably moves from the spaced position to the adjacent position. And, the developing roller 40 contacts the photosensitive drum 30. This completes installation of the developing cartridge 4 into the drum cartridge 3.

2.4 Operations and Effects

According to the image forming apparatus 10, the first guide 6 of the swing plate 5 guides installation of the developing cartridge 4 into the drum cartridge 3.

Thus, the developing cartridge 4 can be smoothly installed into the drum cartridge 3. The swing plate 5 supports the developing cartridge 4 installed in the drum cartridge 3. Hence, in a state where the developing cartridge 4 is installed in the drum cartridge 3, when the swing plate 5 swingably moves, the developing cartridge 4 moves together with swing movement of the swing plate 5. As a result, the developing roller 40 is moved relative to the photosensitive drum 30.

3. Second Embodiment

An image forming apparatus 70 of a second embodiment will be described while referring to FIG. 8 to FIG. 11. In the image forming apparatus 70 of the second embodiment, parts and components similar to those described in the above-described first embodiment are designated by the same reference numerals to avoid duplicating description.

Figure 8:
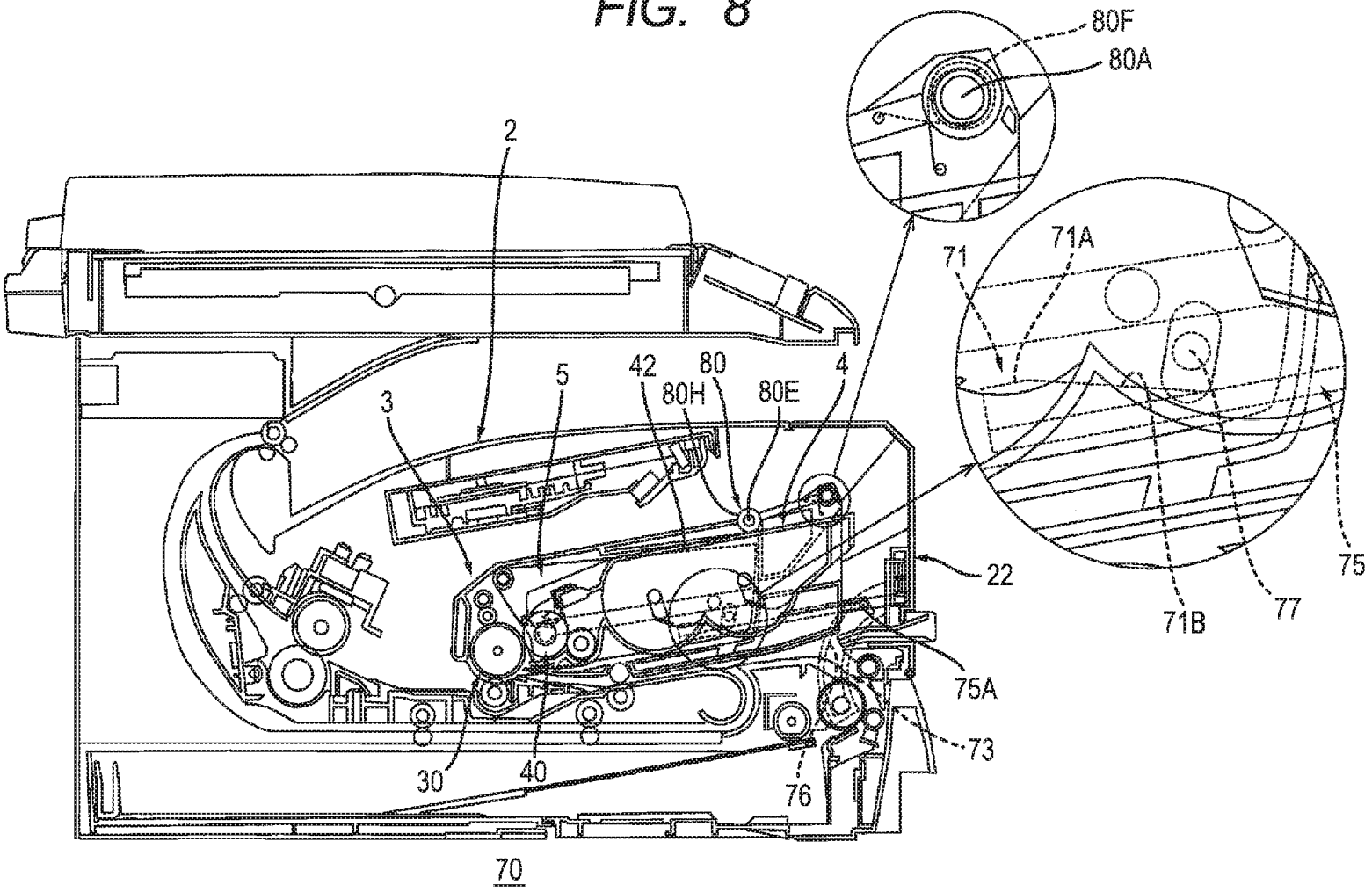
FIG. 8 is a cross-sectional view of an image forming apparatus of a second embodiment, and shows a state where a cam is located at a noncontact position.
Figure 9:
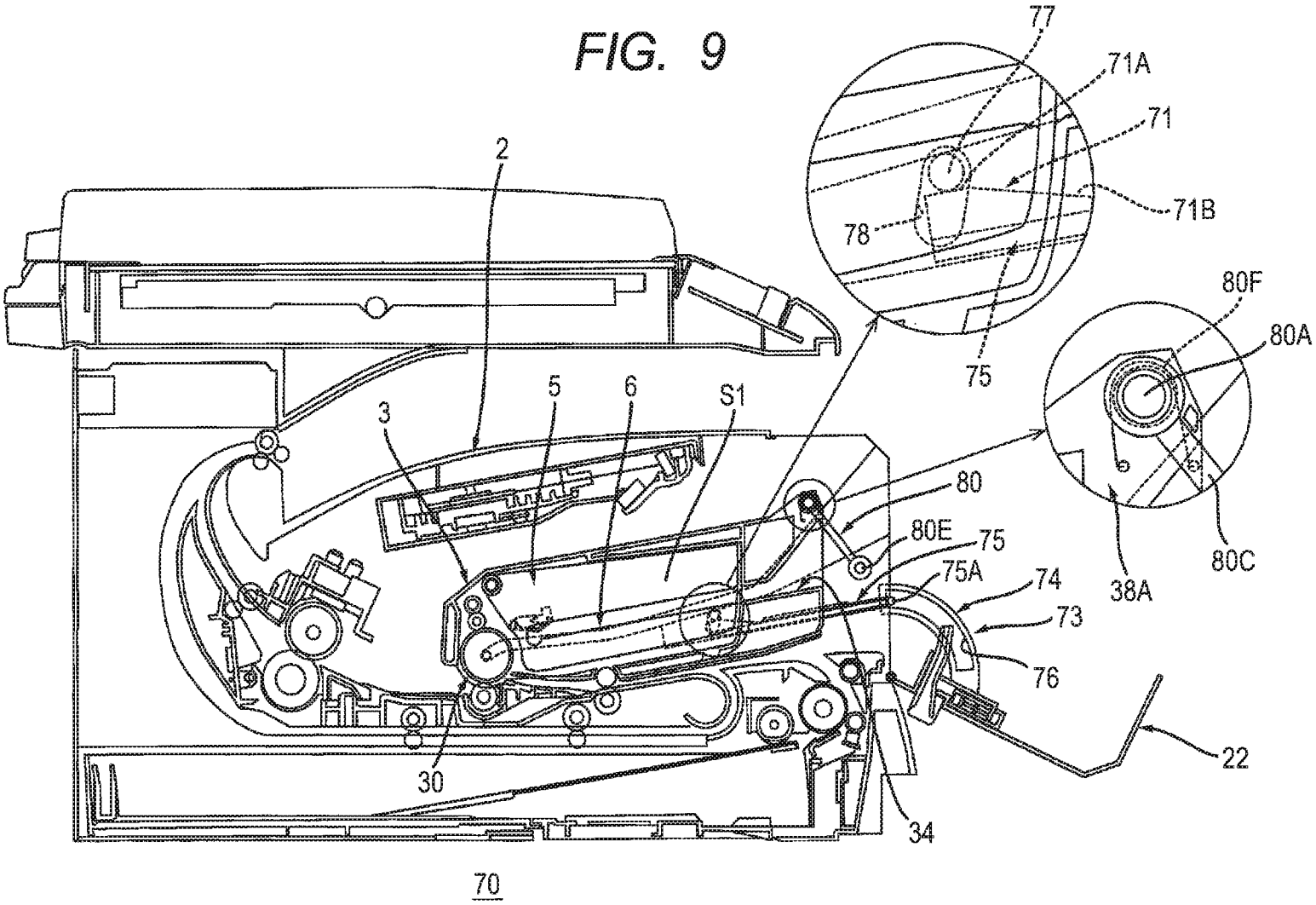
FIG. 9 is a cross-sectional view of the image forming apparatus shown in FIG. 8, and shows a state where the cam is located at a contact position.

As shown in FIG. 8 and FIG. 9, in the image forming apparatus 70, the swing plate 5 moves between the spaced position and the adjacent position in conjunction with movement of the cover 22. Specifically, in a state where the drum cartridge 3 is installed in the apparatus main body 2, the swing plate 5 is located at the adjacent position (see FIG. 8) when the cover 22 is located at the closed position, and is located at the spaced position (see FIG. 9) when the cover 22 is located at the open position. Further, in a state where the drum cartridge 3 in which the developing cartridge 4 is installed is installed in the apparatus main body 2, the developing roller 40 contacts the photosensitive drum 30 when the swing plate 5 is located at the adjacent position, and the developing roller 40 is spaced from the photosensitive drum 30 when the swing plate 5 is located at the spaced position. The detailed structure of the image forming apparatus 70 of the second embodiment will be described below.

3.1 Detail of Apparatus Main Body 2

The apparatus main body 2 includes a cam 71 and a coupling member 73.

The cam 71 is configured to move between: a contact position (see FIG. 9) at which the cam 71 contacts the swing plate 5 and causes the swing plate 5 to be located at the spaced position in a state where the drum cartridge 3 is installed in the apparatus main body 2 and where the cover 22 is located at the open position; and a noncontact position (see FIG. 8) at which the cam 71 stops a contact with the swing plate 5 and the swing plate 5 is located at the adjacent position in a state where the drum cartridge 3 is installed in the apparatus main body 2 and where the cover 22 is located at the closed position. The cam 71 moves in conjunction with movement of the cover 22.

As shown in FIG. 9, the cam 71 is supported by the coupling member 73. The coupling member 73 couples the cover 22 with the cam 71. The coupling member 73 causes the cover 22 and the cam 71 to move in an interlocking manner When the cover 22 moves from the open position to the closed position, the coupling member 73 causes the cam 71 to move from the contact position to the noncontact position. When the cover 22 moves from the closed position to the open position, the coupling member 73 causes the cam 71 to move from the noncontact position to the contact position. The coupling member 73 includes a first coupling portion 74 and a second coupling portion 75. The first coupling portion 74 is fixed to the cover 22. The first coupling portion 74 has an elongated hole 76. The second coupling portion 75 couples the cam 71 with the first coupling portion 74. The second coupling portion 75 has one end supporting the cam 71 and an other end coupled with the first coupling portion 74. The one end of the second coupling portion 75 is located away from the other end of the second coupling portion 75. The cam 71 is arranged at an upper surface of the one end of the second coupling portion 75. The second coupling portion 75 includes a boss 75A. The boss 75A is located at the other end of the second coupling portion 75. The boss 75A extends in the axial direction. The boss 75A is fitted in the elongated hole 76 of the first coupling portion 74. The elongated hole 76 extends in the rotational movement direction of the cover 22. The elongated hole 76 has one end and an other end in the rotational movement direction of the cover 22. In a state where the cover 22 is located at the open position, the boss 75A is located at the one end of the elongated hole 76 and contacts the first coupling portion 74. With this configuration, the second coupling portion 75 is pulled by the first coupling portion 74, and the cam 71 is located at the contact position. The cam 71 has a contact surface 71A and a sloped surface 71B. In a state where the cam 71 is located at the contact position, the contact surface 71A contacts a part of the swing plate 5, specifically, a contact portion 77 (described later). The sloped surface 71B couples the upper surface of the second coupling portion 75 with the contact surface 71A.

As shown in FIG. 8, when the cover 22 moves from the open position to the closed position, the boss 75A moves from the one end to the other end of the elongated hole 76 and contacts the first coupling portion 74. With this operation, the second coupling portion 75 is pushed by the first coupling portion 74, and causes the cam 71 to move from the contact position to the noncontact position. When the cam 71 is located at the noncontact position, the cam 71 is spaced from the swing plate 5. Specifically, when the cam 71 is located at the noncontact position, the contact surface 71A of the cam 71 is spaced from the contact portion 77 (described later).

3.2 Detail of Swing Plate 5

Figure 10:
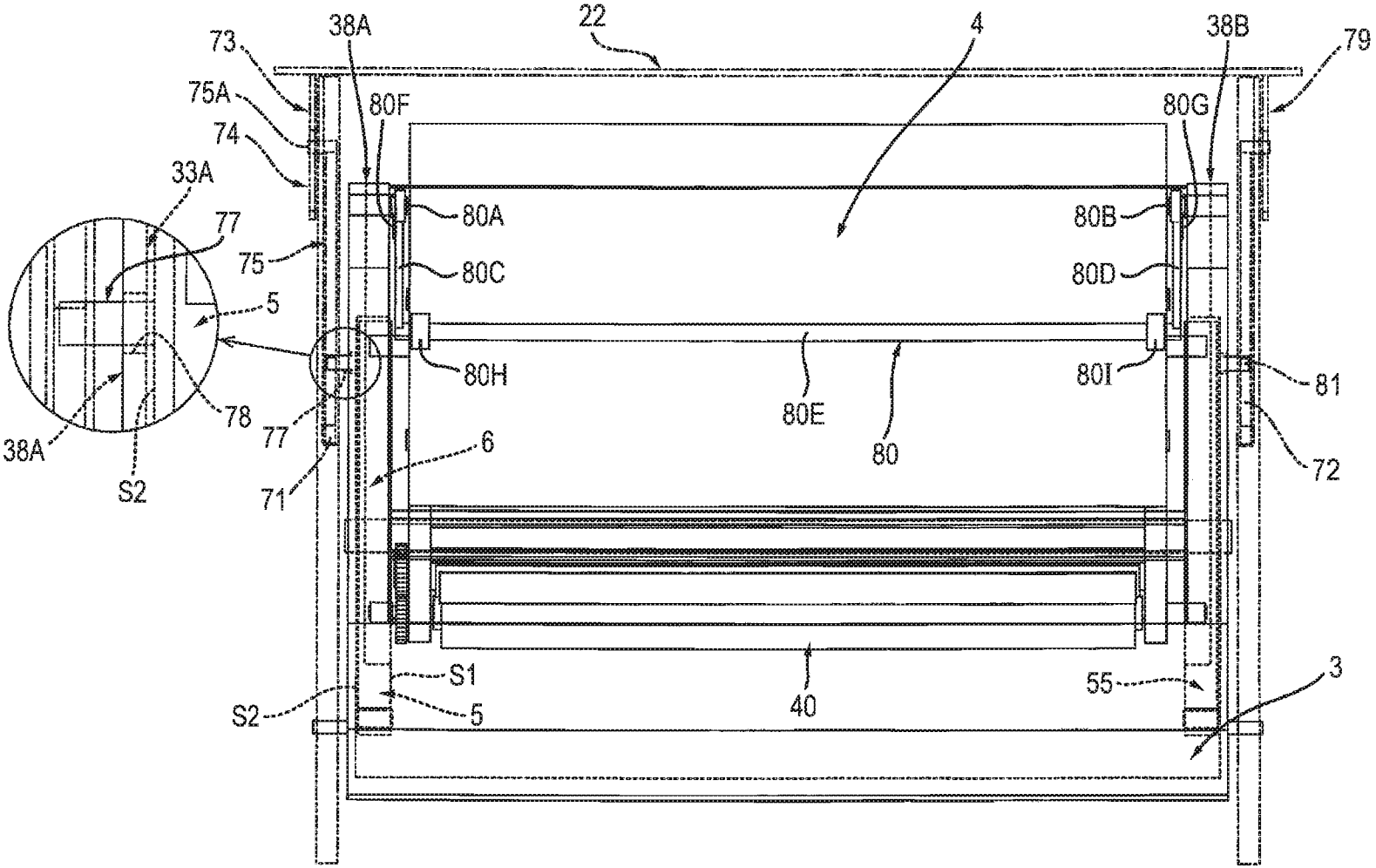
FIG. 10 is a plan view showing a state where a drum cartridge in which a developing cartridge is installed is installed in an apparatus main body shown in FIG. 8.

As shown in FIG. 10, the swing plate 5 includes the contact portion 77 (see FIG. 9) configured to contact the cam 71 in a state where the drum cartridge 3 is installed in the apparatus main body 2 and where the cover 22 is located at the open position. The swing plate 5 has the inner surface 51 and the outer surface S2 in the axial direction. In a state where the developing cartridge 4 is installed in the drum cartridge 3, the outer surface S2 is located at the opposite side from the developing cartridge 4 with respect to the inner surface 51 in the axial direction. The contact portion 77 is located at the outer surface S2 of the swing plate 5. The contact portion 77 protrudes from the swing plate 5. The contact portion 77 is fitted in a hole 78 formed in the first side frame 38A. The contact portion 77 extends in the axial direction. The contact portion 77 has one end and an other end in the axial direction. The one end of the contact portion 77 is located at the opposite side from the developing cartridge 4 installed in the drum cartridge 3 with respect to the first side frame 38A. The other end of the contact portion 77 is connected to the swing plate 5. In a state where the cam 71 is located at the contact position, the one end of the contact portion 77 contacts the contact surface 71A of the cam 71 (see FIG. 9). In a state where the cam 71 is located at the noncontact position, the one end of the contact portion 77 is spaced from the contact surface 71A of the cam 71 (see FIG. 8). In a state where the cam 71 is located at the noncontact position, the one end of the contact portion 77 is spaced from the upper side of the sloped surface 71B of the cam 71 with an interval therebetween (see FIG. 8).

3.3 Detail of Drum Cartridge 3

The drum cartridge 3 further includes a handle 80. The handle 80 is gripped by the user when the drum cartridge 3 is installed into the apparatus main body 2 or when the drum cartridge 3 is removed from the apparatus main body 2. The handle 80 is configured to rotatably move between: a pressing position (see FIG. 8) at which the handle 80 presses the developing cartridge 4 such that the swing plate 5 moves toward the adjacent position in a state where the developing cartridge 4 is installed in the drum cartridge 3; and a pressing release position (see FIG. 9) at which pressing against the developing cartridge 4 is stopped in a state where the developing cartridge 4 is removed from the drum cartridge 3. The handle 80 is configured to rotatably move between the pressing position and the pressing release position about a rotational axis extending in the axial direction.

The handle 80 includes a first rotational shaft 80A, a second rotational shaft 80B, a first arm 80C, a second arm 80D, a coupling portion 80E, a first torsion coil spring 80F (see FIG. 9), and a second torsion coil spring 80G. The first rotational shaft 80A and the second rotational shaft 80B extend along the rotational axis of the handle 80. The first rotational shaft 80A is rotatably supported by the first side frame 38A. The second rotational shaft 80B is rotatably supported by the second side frame 38B. The first arm 80C couples the first rotational shaft 80A with the coupling portion 80E. The first arm 80C has one end fixed to the first rotational shaft 80A and an other end located away from the one end. The second arm 80D couples the second rotational shaft 80B with the coupling portion 80E. The second arm 80D has one end fixed to the second rotational shaft 80B and an other end located away from the one end. The coupling portion 80E couples the other end of the first arm 80C with the other end of the second arm 80D. The first torsion coil spring 80F and the second torsion coil spring 80G press the handle 80 such that the handle 80 moves from the pressing position toward the pressing release position. The coupling portion 80E is provided with a pair of abutment portions 80H, 80I. The outer diameter of the pair of abutment portions 80H, 80I is larger than the outer diameter of the coupling portion 80E.

As shown in FIG. 9, the first rotational shaft 80A is inserted in the first torsion coil spring 80F. One end of the first torsion coil spring 80F is fixed to the first side frame 38A. The other end of the first torsion coil spring 80F is fixed to the first arm 80C. The second rotational shaft 80B is inserted in the second torsion coil spring 80G (see FIG. 10). One end of the second torsion coil spring 80G is fixed to the second side frame 38B (see FIG. 10). The other end of the second torsion coil spring 80G is fixed to the second arm 80D (see FIG. 10).

In a state where the handle 80 is located at the pressing release position, the coupling portion 80E is located at the upstream side of the second guide 34 in the installation direction of the developing cartridge 4.

As shown in FIG. 8, in a state where the developing cartridge 4 is installed in the drum cartridge 3, the handle 80 contacts the developing cartridge 4 and is located at the pressing position. In a state where the handle 80 is located at the pressing position, the coupling portion 80E is located at the upper side of the frame 42. In a state where the handle 80 is located at the pressing position, the abutment portions 80H, 80I of the coupling portion 80E press the frame 42 downward from above with the pressing force of the first torsion coil spring 80F and the second torsion coil spring 80G. With this configuration, the swing plate 5 is reliably located at the adjacent position.

3.4 Other Configuration

As shown in FIG. 10, the apparatus main body 2 includes a second cam 72 having the same shape as the cam 71 and a second coupling member 79 having the same shape as the coupling member 73. Like the cam 71, the second cam 72 is configured to move between: a contact position for causing the second swing plate 55 to be located at the spaced position; and a noncontact position for causing the second swing plate 55 to be located at the adjacent position. The second coupling member 79 causes the cover 22 and the second cam 72 to move in an interlocking manner The second swing plate 55 includes a second contact portion 81 having the same shape as the contact portion 77. In a state where the drum cartridge 3 is installed in the apparatus main body 2 and where the cover 22 is located at the open position, the second contact portion 81 contacts the second cam 72.

3.5 Installation of Drum Cartridge 3 and Developing Cartridge 4

Figure 11:
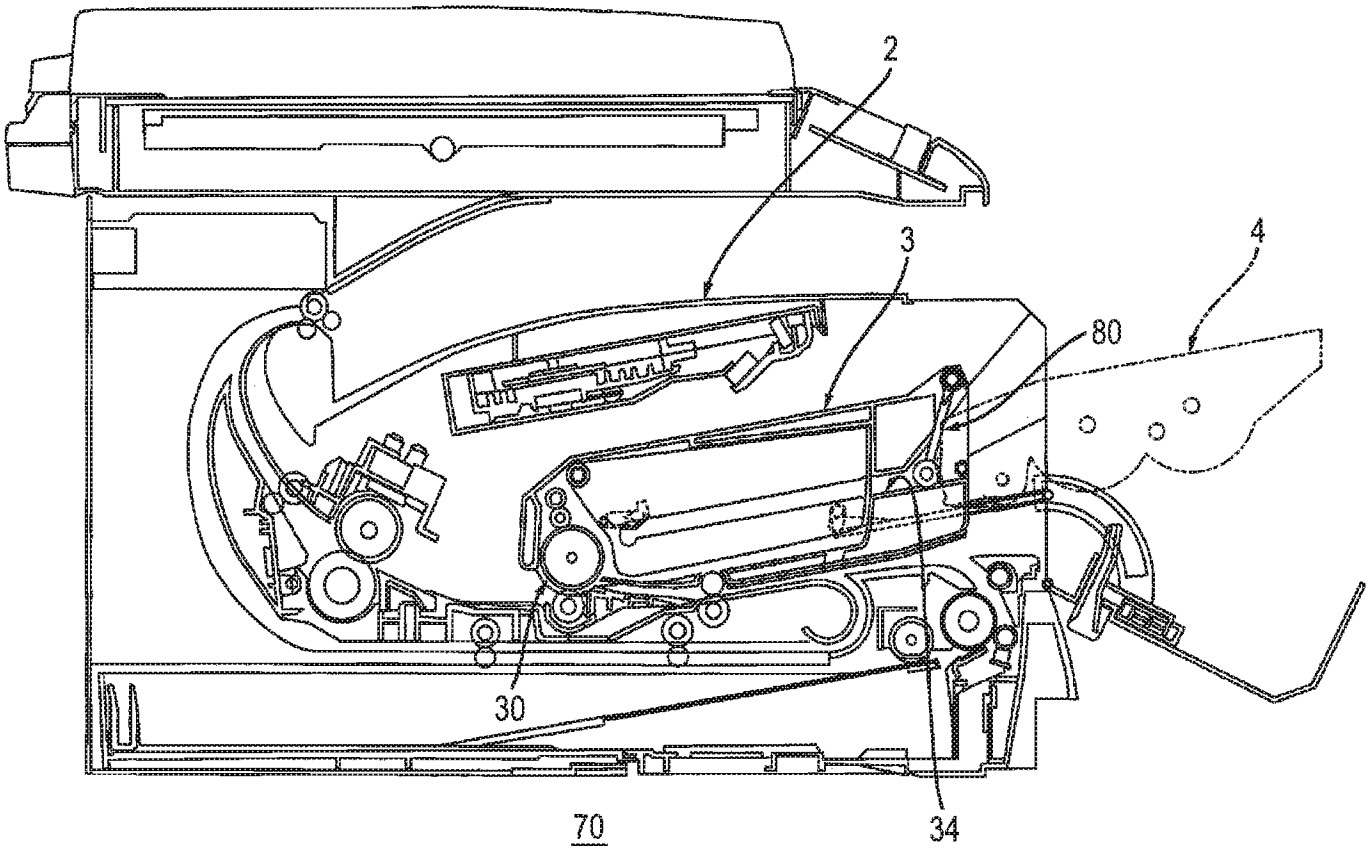
FIG. 11 is an explanatory diagram for illustrating installation of the developing cartridge into the drum cartridge shown in FIG. 9, and shows a state where the developing cartridge contacts a handle.

As shown in FIG. 11, when the user installs the developing cartridge 4 into the drum cartridge 3 installed in the apparatus main body 2, the developing cartridge 4 contacts the handle 80 located at the pressing release position. And, when the user fits the developing cartridge 4 into the second guide 34 and pushes the developing cartridge 4 toward the photosensitive drum 30, the handle 80 rotatably moves from the pressing release position toward the pressing position against the pressing force of the first torsion coil spring 80F and the second torsion coil spring 80G. And, as shown in FIG. 8, in a state where the developing cartridge 4 is installed in the drum cartridge 3, the handle 80 presses the developing cartridge 4 downward from above. At this time, the abutment portions 80H, 80I of the handle 80 are located at the outer side, in the axial direction, of a main body portion of the developing roller 40 that contacts the photosensitive drum 30 (that is, the main body portion contacts the photosensitive drum 30). That is, the main body portion of the developing roller 40 that contacts the photosensitive drum 30 is located between the abutment portion 80H of the handle 80 and the abutment portion 80I of the handle 80 in the axial direction. Thus, the abutment portions 80H, 80I of the handle 80 do not contact the main body portion of the developing roller 40 that contacts the photosensitive drum 30.

3.6 Operations and Effects

As shown in FIG. 8 and FIG. 9, in a state where the cover 22 is located at the open position, the cam 71 is located at the contact position at which the cam 71 contacts the swing plate 5 and causes the swing plate 5 to be located at the spaced position (see FIG. 9). In a state where the cover 22 is located at the closed position, the cam 71 is located at the noncontact position at which the cam 71 stops contact with the swing plate 5 and causes the swing plate 5 to be located at the adjacent position (see FIG. 8). The cam 71 moves between the contact position and the noncontact position in conjunction with movement of the cover 22.

Thus, when the user puts the cover 22 at the open position in order to install the developing cartridge 4 into the drum cartridge 3, the swing plate 5 is located at the spaced position by the cam 71. When the user moves the cover 22 to the closed position after the developing cartridge 4 is installed in the drum cartridge 3, the swing plate 5 is located at the adjacent position. With this configuration, the developing roller 40 can be moved relative to the photosensitive drum 30, so that the developing roller 40 contacts the photosensitive drum 30.

When the user moves the cover 22 from the closed position to the open position in order to remove the developing cartridge 4 from the drum cartridge 3, the swing plate 5 is moved by the cam 71 from the adjacent position to the spaced position. With this operation, the developing roller 40 is spaced from the photosensitive drum 30. After that, the developing cartridge 4 is removed from the drum cartridge 3.

That is, after the developing roller 40 is spaced from the photosensitive drum 30, the developing cartridge 4 is removed from the drum cartridge 3. Thus, the developing cartridge 4 can be removed smoothly from the drum cartridge 3. In the second embodiment, too, operations and effects similar to those in the above-described first embodiment are obtained.

4. Third Embodiment

An image forming apparatus 90 of a third embodiment will be described while referring to FIG. 12 and FIG. 13. In the image forming apparatus 90 of the third embodiment, parts and components similar to those described in the image forming apparatus 10 of the above-described first embodiment are designated by the same reference numerals to avoid duplicating description.

In the image forming apparatus 90, in a state where the developing cartridge 4 is installed in the drum cartridge 3, the swing center 50A of the swing plate 5 is located at a lower position than the developing roller 40. In a state where the cover 22 is located at the closed position, the swing plate 5 is located at the adjacent position (see FIG. 12). In a state where the swing plate 5 is located at the adjacent position, the lower end 6AB of the upstream end 6A of the first guide 6 and the upper end 34BA of the downstream end 34B of the second guide 34 are spaced from each other with an interval L4 therebetween. The interval L4 is smaller than the radius of the protrusion 43 of the developing cartridge 4. Thus, the protrusion 43 cannot move between the first guide 6 and the second guide 34. That is, the swing plate 5 prevents the developing cartridge 4 from being guided from the first guide 6 to the second guide 34. In a state where the cover 22 is located at the open position, the swing plate 5 is located at the spaced position (see FIG. 13). In a state where the swing plate 5 is located at the spaced position, the upstream end 6A of the first guide 6 is almost aligned with the downstream end 34B of the second guide 34, and the lower end 6AB of the upstream end 6A and the upper end 34BA of the downstream end 34B are spaced from each other with an interval L3 therebetween. The interval L3 is larger than the outer diameter of the protrusion 43. The detailed structure of the image forming apparatus 90 of the third embodiment will be described below.

4.1 Detail of Apparatus Main Body 2

Figure 12:
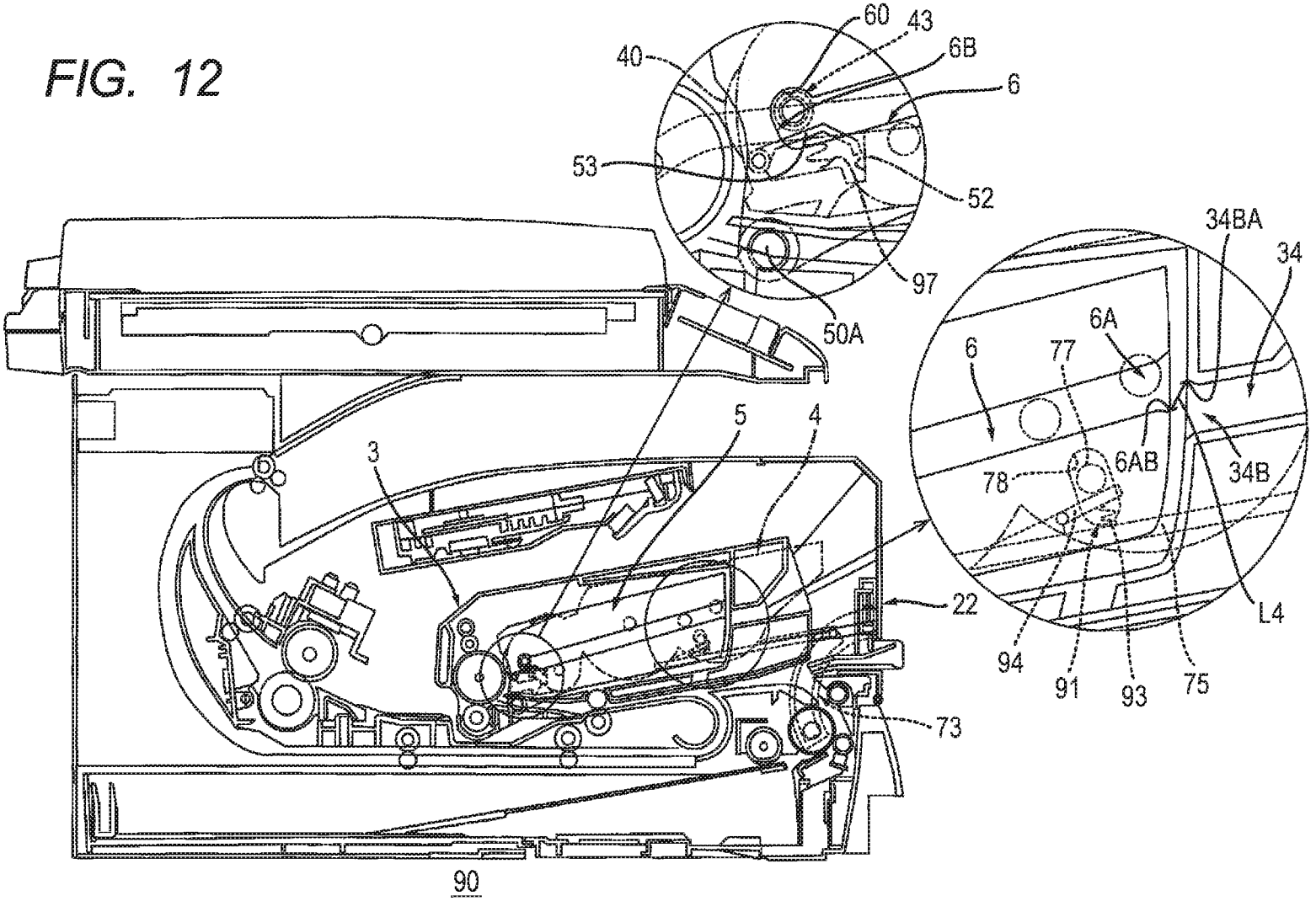
FIG. 12 is a cross-sectional view of an image forming apparatus of a third embodiment, and shows a state where a pressing member is located at a pressing position.
Figure 13:
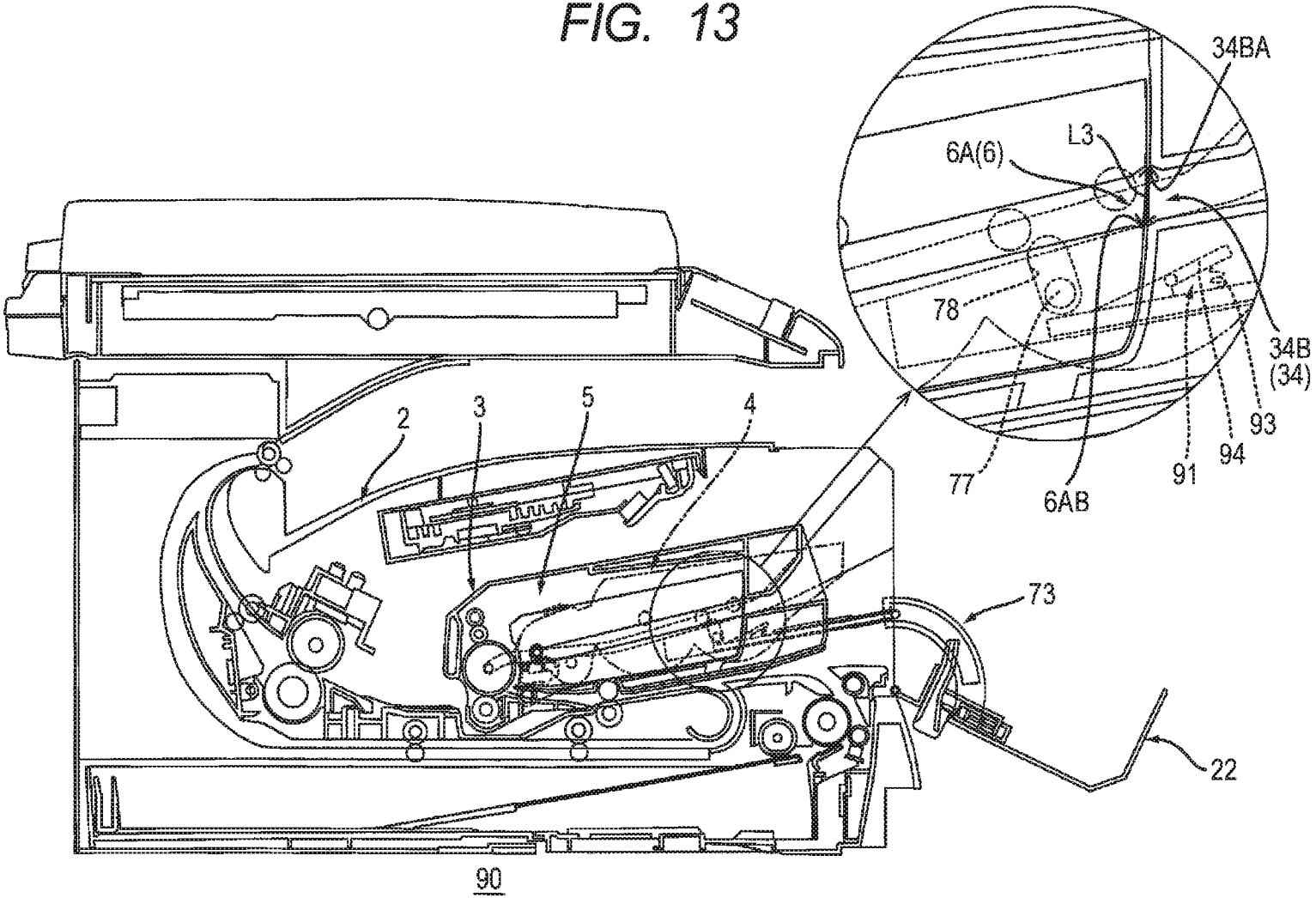
FIG. 13 is a cross-sectional view of the image forming apparatus shown in FIG. 12, and shows a state where the pressing member is located at a pressing release position.

As shown in FIG. 12, the apparatus main body 2 further includes a pressing member 91 and the coupling member 73. The pressing member 91 is configured to move between: a pressing position (see FIG. 12) at which the pressing member 91 presses the swing plate 5 toward the adjacent position in a state where the drum cartridge 3 is installed in the apparatus main body 2 and where the cover 22 is located at the closed position; and a pressing release position (see FIG. 13) at which the pressing member 91 stops pressing against the swing plate 5 and causes the swing plate 5 to be located at the spaced position in a state where the drum cartridge 3 is installed in the apparatus main body 2 and where the cover 22 is located at the open position. The pressing member 91 moves in conjunction with movement of the cover 22.

The pressing member 91 is supported by the second coupling portion 75 of the coupling member 73. The pressing member 91 is arranged at the upper surface of the second coupling portion 75. The pressing member 91 includes a pressing spring 93 and a pressing plate 94. In a state where the pressing member 91 is located at the pressing position, the pressing spring 93 presses the swing plate 5 upward from below.

Specifically, in a state where the pressing member 91 is located at the pressing position, the pressing spring 93 presses the contact portion 77 upward from below. The pressing spring 93 extends in the upper-lower direction. The pressing spring 93 is arranged between the second coupling portion 75 and the pressing plate 94. The lower end of the pressing spring 93 contacts the upper surface of the second coupling portion 75. The upper end of the pressing spring 93 contacts the pressing plate 94. The pressing plate 94 is swingably provided at the second coupling portion 75. In a state where the pressing member 91 is located at the pressing position, the pressing plate 94 contacts the swing plate 5. Specifically, in a state where the pressing member 91 is located at the pressing position, the pressing plate 94 contacts the contact portion 77. In a state where the pressing plate 94 contacts the swing plate 5, the pressing spring 93 is compressed in the upper-lower direction. In a compressed state, the pressing spring 93 presses the swing plate 5 with elastic force. With this configuration, the pressing member 91 presses the swing plate 5 toward the adjacent position. In a state where the pressing member 91 is located at the pressing release position, the pressing plate 94 is spaced from the swing plate 5 (see FIG. 13). With this configuration, the pressing member 91 stops pressing against the swing plate 5. Then, the swing plate 5 moves from the adjacent position to the spaced position by its own weight.

The coupling member 73 couples the cover 22 with the pressing member 91. The coupling member 73 causes the cover 22 and the pressing member 91 to move in an interlocking manner When the cover 22 moves from the open position to the closed position, the coupling member 73 causes the pressing member 91 to move from the pressing release position to the pressing position. When the cover 22 moves from the closed position to the open position, the coupling member 73 causes the pressing member 91 to move from the pressing position to the pressing release position.

4.2 Detail of Swing Plate 5

The swing plate 5 further includes a first pressing spring 97. In a state where the developing cartridge 4 is installed in the drum cartridge 3, the first pressing spring 97 presses the protrusion 43 upward from below and causes the protrusion 43 to contact the first guide 6. Specifically, in a state where the developing cartridge 4 is installed in the apparatus main body 2, the first pressing spring 97 presses the protrusion 43 upward from below and causes the protrusion 43 to contact the downstream end 6B of the first guide 6. In a state where the developing cartridge 4 is installed in the apparatus main body 2, the first pressing spring 97 is located at the lower side of the protrusion 43 located at the downstream end 6B of the first guide 6. The first pressing spring 97 is arranged in the groove 52 formed in the swing plate 5. The first pressing spring 97 extends in the upper-lower direction. The lower end of the first pressing spring 97 contacts the inner surface of the groove 52. The upper end of the first pressing spring 97 contacts the swing portion 53 provided swingably at the swing plate 5. The swing portion 53 contacts the protrusion 43 located at the downstream end 6B of the first guide 6. In a state where the swing portion 53 contacts the protrusion 43, the first pressing spring 97 is compressed in the upper-lower direction. In a compressed state, the first pressing spring 97 presses the protrusion 43 with elastic force.

4.3 Operations and Effects

In the third embodiment, too, operations and effects similar to those in the above-described first embodiment and second embodiment are obtained.

While the disclosure has been described in detail with reference to the above aspects thereof, it would be apparent to those skilled in the art that various changes and modifications may be made therein without departing from the scope of the claims.

What is claimed is:

1. An image forming apparatus comprising:

an apparatus main body formed with an opening;

a drum cartridge including a photosensitive drum and configured to be installed into the apparatus main body through the opening; and a developing cartridge including a developing roller and configured to be installed into the drum cartridge, the drum cartridge including a side frame configured to rotatably support the photosensitive drum, the drum cartridge including a swing plate configured to support the developing cartridge installed in the drum cartridge, the swing plate being provided at the side frame of the drum cartridge, the swing plate being configured to swingably move such that the developing roller moves relative to the photosensitive drum, the swing plate including a first guide configured to guide installation of the developing cartridge into the drum cartridge.

2. The image forming apparatus according to claim 1, wherein the swing plate includes a swing shaft extending along a swing center of the swing plate; and wherein the swing shaft is rotatably supported by the side frame.

3. The image forming apparatus according to claim 1, wherein the swing plate is configured to, in a state where the developing cartridge is installed in the drum cartridge, swingably move between an adjacent position at which the developing roller contacts or is adjacent to the photosensitive drum and a spaced position at which the developing roller is farther spaced from the photosensitive drum than at the adjacent position.

4. The image forming apparatus according to claim 3, wherein the drum cartridge including a second guide configured to guide the developing cartridge to the first guide of the swing plate; and wherein the swing plate is configured to allow the developing cartridge to be guided from the first guide to the second guide in a state where the developing cartridge is installed in the drum cartridge and where the swing plate is located at the spaced position.

5. The image forming apparatus according to claim 4, wherein, in a state where the swing plate is located at the spaced position, an upstream end of the first guide is aligned with a downstream end of the second guide; and wherein, in a state where the swing plate is located at the adjacent position, the upstream end of the first guide is farther shifted relative to the downstream end of the second guide than at the spaced position.

6. The image forming apparatus according to claim 5, wherein the developing roller includes a developing shaft extending in an axial direction; and wherein, in a state where the swing plate is located at the adjacent position, an interval between an upper end of the upstream end of the first guide and a lower end of the downstream end of the second guide in a direction perpendicular to the axial direction and passing through the upper end and the lower end is smaller than an outer diameter of the developing shaft.

7. The image forming apparatus according to claim 3, wherein a swing center of the swing plate is located at a higher position than the developing roller in a state where the developing cartridge is installed in the drum cartridge.

8. The image forming apparatus according to claim 7, wherein the developing cartridge includes:

a frame configured to accommodate toner; and a protrusion protruding from the frame;

wherein the first guide is configured to guide the protrusion when the developing cartridge is installed into the drum cartridge; and wherein the swing plate includes a pressing spring configured to, in a state where the developing cartridge is installed in the drum cartridge, press the protrusion downward from above and cause the protrusion to contact the first guide.

9. The image forming apparatus according to claim 8, wherein the developing roller includes a developing shaft extending along a rotational axis of the developing roller; and wherein the protrusion includes a part of the developing shaft.

10. The image forming apparatus according to claim 7, wherein the drum cartridge includes a first pressing spring arranged at a lower side of the swing plate and configured to press the swing plate in a direction from the adjacent position toward the spaced position.

11. The image forming apparatus according to claim 10, wherein the apparatus main body includes a second pressing spring located at an opposite side from the first pressing spring with respect to the first guide in a state where the drum cartridge is installed in the apparatus main body; and wherein the second pressing spring is configured to, in a state where the drum cartridge in which the developing cartridge is installed is installed in the apparatus main body, press the developing cartridge and cause the swing plate to be located at the adjacent position against the first pressing spring.

12. The image forming apparatus according to claim 11, wherein a pressing force of the second pressing spring is larger than pressing force of the first pressing spring.

13. The image forming apparatus according to claim 3, wherein the drum cartridge includes a handle; and wherein the handle is configured to rotatably move between:

a pressing position at which the handle presses the developing cartridge such that the swing plate moves toward the adjacent position in a state where the developing cartridge is installed in the drum cartridge; and a pressing release position at which the handle does not press the developing cartridge in a state where the developing cartridge is removed from the drum cartridge.

14. The image forming apparatus according to claim 13, wherein the apparatus main body includes:

a cover configured to move between an open position at which the opening of the apparatus main body is opened and a closed position at which the opening is closed; and a cam configured to move in conjunction with movement of the cover;

wherein the cam is configured to move between:

a contact position at which the cam contacts the swing plate and causes the swing plate to be located at the spaced position in a state where the drum cartridge is installed in the apparatus main body and where the cover is located at the open position; and a noncontact position at which the cam does not contact the swing plate and causes the swing plate to be located at the adjacent position in a state where the drum cartridge is installed in the apparatus main body and where the cover is located at the closed position.

15. The image forming apparatus according to claim 14, wherein the swing plate includes a contact portion configured to contact the cam in a state where the drum cartridge is installed in the apparatus main body and where the cover is located at the open position.

16. The image forming apparatus according to claim 3, wherein a swing center of the swing plate is located at a lower position than the developing roller in a state where the developing cartridge is installed in the drum cartridge.

17. The image forming apparatus according to claim 16, wherein the developing cartridge includes:

a frame configured to accommodate toner; and a protrusion protruding from the frame;

wherein the first guide is configured to guide the protrusion when the developing cartridge is installed into the drum cartridge; and wherein the swing plate includes a first pressing spring configured to, in a state where the developing cartridge is installed in the drum cartridge, press the protrusion upward from below and cause the protrusion to contact the first guide.

18. The image forming apparatus according to claim 16, wherein the apparatus main body includes:

a cover configured to move between an open position at which the opening of the apparatus main body is opened and a closed position at which the opening is closed; and a pressing member configured to move in conjunction with movement of the cover; and wherein the pressing member is configured to move between:

a pressing position at which the pressing member presses the swing plate toward the adjacent position in a state where the drum cartridge is installed in the apparatus main body and where the cover is located at the closed position; and a pressing release position at which the pressing member does not press the swing plate and causes the swing plate to be located at the spaced position in a state where the drum cartridge is installed in the apparatus main body and where the cover is located at the open position.

19. The image forming apparatus according to claim 1, wherein a concave portion is provided at the side frame, and the concave portion accommodates the swing plate.

* * * * *